US007758412B2

(12) United States Patent
Okada

(10) Patent No.: US 7,758,412 B2
(45) Date of Patent: Jul. 20, 2010

(54) GAMING MACHINES WITH IMAGE OF A DEALER DISPLAYED ON COMMON DISPLAY

(75) Inventor: Kazuo Okada, Tokyo (JP)

(73) Assignee: Universal Entertainment Corporation, Koto-ku, Tokyo (JP)

( * ) Notice: Subject to any disclaimer, the term of this patent is extended or adjusted under 35 U.S.C. 154(b) by 309 days.

(21) Appl. No.: 11/518,426

(22) Filed: Sep. 11, 2006

(65) Prior Publication Data

US 2007/0060267 A1 Mar. 15, 2007

(30) Foreign Application Priority Data

Sep. 14, 2005 (JP) ..... 2005-267008

(51) Int. Cl.
*A63F 9/00* (2006.01)

(52) U.S. Cl. ..... 463/16

(58) Field of Classification Search ..... 463/16
See application file for complete search history.

(56) References Cited

U.S. PATENT DOCUMENTS

| | | | | |
|---|---|---|---|---|
| 5,491,777 | A * | 2/1996 | Mase et al. | 463/31 |
| 6,142,875 | A * | 11/2000 | Kodachi et al. | 463/20 |
| 6,607,443 | B1 * | 8/2003 | Miyamoto et al. | 463/40 |
| 7,322,883 | B2 * | 1/2008 | Toyoda | 463/11 |
| 2004/0063482 | A1 * | 4/2004 | Toyoda | 463/11 |
| 2004/0072602 | A1 * | 4/2004 | Toyoda | 463/10 |
| 2004/0092312 | A1 * | 5/2004 | Toyoda | 463/42 |
| 2006/0014577 | A1 * | 1/2006 | Snow | 463/12 |
| 2008/0076541 | A1 * | 3/2008 | Yoshizawa et al. | 463/26 |
| 2008/0108412 | A1 * | 5/2008 | Snow et al. | 463/20 |
| 2008/0167103 | A1 * | 7/2008 | Okada | 463/11 |

FOREIGN PATENT DOCUMENTS

JP 2004-008706 1/2004

OTHER PUBLICATIONS

AV Poker (released 1991) <http://www.famicomworld.com/Reviews/AV$_{13}$ Poker.htm>.*

* cited by examiner

*Primary Examiner*—Peter DungBa Vo
*Assistant Examiner*—Seng Heng Lim
(74) *Attorney, Agent, or Firm*—McGinn IP Law Group, PLLC

(57) ABSTRACT

To give a player a feeling of reality in a game in accordance with an amount of coins bet.

A gaming machine which provides a prescribed game using a plurality of player terminals, on which a game situation of each individual player is displayed, and a common display, on which a game situation of all players is displayed, includes: a game controller 901 which carries out a control for expediting a game; a terminal controller 304A; and an effect content memory 902 which stores effect contents which change contents of a dealer image displayed on the common display in accordance with an amount of coins bet on the player terminal, wherein the game controller 901 changes display contents of the dealer image when one or more coins bet in accordance with the amount of the coin bet.

21 Claims, 13 Drawing Sheets

Fig. 10

| TERMINAL NUMBER | AMOUNT OF BET | | | | |
|---|---|---|---|---|---|
| | ~10 | 11~50 | 51~100 | 101~200 | 201~ |
| 1 | EFFECT 1-A | EFFECT 1-B | EFFECT 1-C | EFFECT 1-D | EFFECT 1-E |
| 2 | EFFECT 2-A | EFFECT 2-B | EFFECT 2-C | EFFECT 2-D | EFFECT 2-E |
| 3 | EFFECT 3-A | EFFECT 3-B | EFFECT 3-C | EFFECT 3-D | EFFECT 3-E |
| 4 | EFFECT 4-A | EFFECT 4-B | EFFECT 4-C | EFFECT 4-D | EFFECT 4-E |
| 5 | EFFECT 5-A | EFFECT 5-B | EFFECT 5-C | EFFECT 5-D | EFFECT 5-E |

GAMING MACHINES WITH IMAGE OF A DEALER DISPLAYED ON COMMON DISPLAY

RELATED APPLICATION

This application claims the priority of Japanese Patent Application No. 2005-267008 filed on Sep. 14, 2005, which is incorporated herein by reference.

BACKGROUND OF THE INVENTION

1. Field of the Invention

The present invention relates to a gaming machine, and particularly to a gaming machine in which one or more coins are bet and a game is carried out and in which, in the event that the game is won, it is possible to acquire an amount of coins in accordance with the amount of the coin or coins bet.

2. Related Art

In recent years, a gaming machine which recreates a sense of reality of a game played in a casino has spread in a market. As this kind of gaming machine, for example, a gaming machine has been proposed which includes a common display device on which an image of a dealer who deals cards is displayed, and an individual display device on which a card game information image is displayed, and which, when dealing the cards, by displaying the dealer in such a way as to face in an installation direction of the individual display device to which the cards are dealt, simulates a situation in which a player is face to face with the dealer, thereby providing a sense of reality (for example, refer to JP-A-2004-8706).

However, in the gaming machine to date described heretofore, only an effect to simulate a situation in which a player is face to face with the dealer when the cards are dealt is carried out, while no effect is carried out in response to an amount of the coins bet by the player. For this reason, as an identical dealer image is displayed regardless of the amount of the coins bet by the player, the player is given a characterless impression, which has been a factor in preventing a recreation of a sense of realism of a game carried out in a casino.

Also, as it is not possible for a spectator who is watching without participating in the game, or a would-be participant who is waiting to participate in the game, to know how much coins a player participating in the game has bet, it is difficult to appreciate the game with a feeling of tension, as would a spectator of a game carried out in a casino etc.

SUMMARY OF THE INVENTION

The invention, bearing in mind the kind of problem described heretofore, has been conceived with an aim of providing a gaming machine which can give a player a sense of reality of a game in accordance with an amount of coins bet.

In order to achieve the aim described heretofore, a gaming machine according to a first aspect of the invention includes: a plurality of player terminals, each of which is equipped with a display on which a game situation of each player is displayed, and a bet receiving device which receives a bet from the player; a common display on which, as well as a game situation of each of a plurality of players, a dealer image is displayed; and a processor which controls the player terminals and the common display, wherein the processor, when the bet receiving device in each of the player terminals receives the bet, executes a control causing display contents of the dealer image displayed on the common display to change in accordance with an amount of the bet.

According to the game machine, a game controller causes the contents of the dealer image when one or more coins are bet to change in accordance with an amount of the coins bet.

A gaming machine according to a second aspect of the invention further includes: a memory including an effect table in which is stored image data, including a plurality of dealer images, correlated to the bet receiving device in each of the plurality of player terminals and the amount of the bet received by each bet receiving device.

A gaming machine according to a third aspect of the invention further includes: a memory including the effect table in which is stored the image data, including the plurality of dealer images, correlated to the bet receiving device in each of the plurality of player terminals and the amount of the bet received by each bet receiving device, wherein the processor, in response to an increase in the amount of the bet, executes a control increasing a degree of change in the display contents of the dealer image displayed on the common display.

A gaming machine according to a fourth aspect of the invention includes: a plurality of player terminals, each of which is equipped with a display on which a game situation of each player is displayed, and a bet receiving device which receives a bet from the player; a common display on which, as well as a game situation of each of a plurality of players, a dealer image is displayed; and a processor which controls the player terminals and the common display, wherein the processor, when the bet receiving device in each of the player terminals receives the bet, executes a control which, as well as causing display contents of the dealer image displayed on the common display to change in accordance with an amount of the bet, increases a degree of change in the display contents of the dealer image displayed on the common display in response to an increase in the amount of the bet.

In a gaming machine according to a fifth aspect of the invention, furthermore, when the bet receiving device newly receives a bet too, a control is executed causing the display contents of the dealer image displayed on the common display to change in accordance with the amount of the bet.

According to a sixth aspect of the invention, in the gaming machine according to the second aspect, furthermore, when the bet receiving device newly receives a bet too, a control is executed causing the display contents of the dealer image displayed on the common display to change in accordance with the amount of the bet.

According to a seventh aspect of the invention, in the gaming machine according to the third aspect, furthermore, when the bet receiving device newly receives a bet too, a control is executed causing the display contents of the dealer image displayed on the common display to change in accordance with the amount of the bet.

According to an eighth aspect of the invention, in the gaming machine according to the fourth aspect, furthermore, when the bet receiving device newly receives a bet too, a control is executed causing the display contents of the dealer image displayed on the common display to change in accordance with the amount of the bet.

According to a ninth aspect of the invention, the gaming machine according to the first aspect further includes: a sub-player terminal on which a bet is carried out after predicting a game result of a player participating in a game using the player terminal.

According to a tenth aspect of the invention, the gaming machine according to the second aspect further includes: a sub-player terminal on which a bet is carried out after predicting a game result of a player participating in a game using the player terminal.

According to an eleventh aspect of the invention, the gaming machine according to the third aspect further includes: a sub-player terminal on which a bet is carried out after predicting a game result of a player participating in a game using the player terminal.

According to a twelfth aspect of the invention, the gaming machine according to the fourth aspect further includes: a sub-player terminal on which a bet is carried out after predicting a game result of a player participating in a game using the player terminal.

A gaming machine according to a thirteenth aspect of the invention includes: a plurality of player terminals, each of which is equipped with a display on which a game situation of each player is displayed, and a bet receiving device which receives a bet from the player; a sub-player terminal on which a bet is carried out after predicting a game result of a player participating in a game using the player terminal; a common display on which, as well as a game situation of each of a plurality of players, a dealer image is displayed; and a processor which controls the player terminals, the sub-player terminal and the common display, wherein the processor, when the bet receiving device in each of the player terminals or the sub-player terminal receives the bet, executes a control causing display contents of the dealer image displayed on the common display to change in accordance with an amount of the bet.

According to a fourteenth aspect of the invention, in the gaming machine according to the thirteenth aspect, furthermore, when the bet receiving device newly receives a bet too, a control is executed causing the display contents of the dealer image displayed on the common display to change in accordance with the amount of the bet.

Additional objects and advantage of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE INVENTION OF THE DRAWINGS

The accompanying drawings, which are incorporated in and constitute a part of the specification, illustrate embodiments of the invention, and together with the general description given above and the detailed description of the embodiments given below, serve to explain the principals of the invention.

FIG. 10 is a view illustrating an example of an effect content table stored in an effect content memory which configures the microcomputer;

Figure 12:
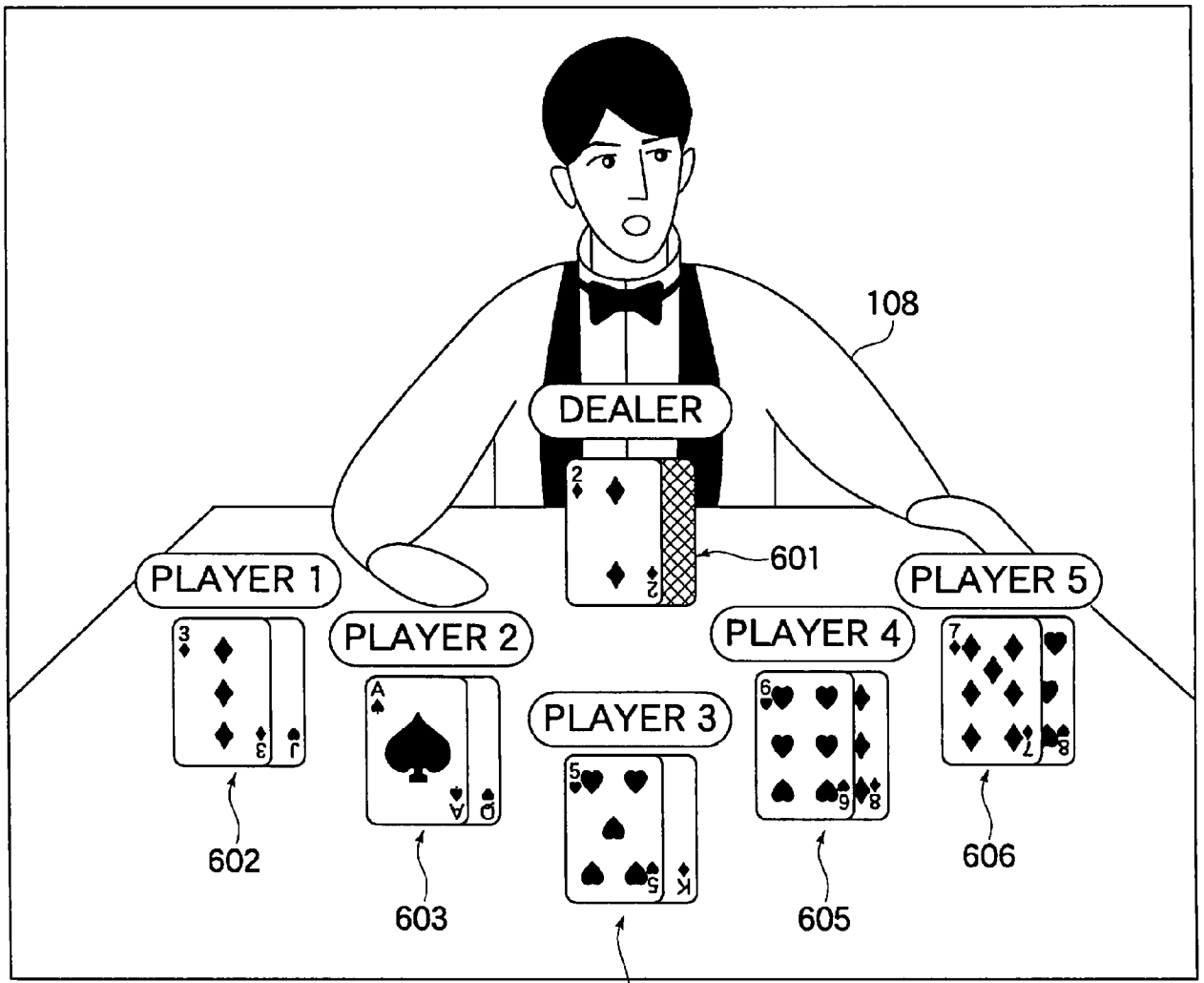
Figure 13:
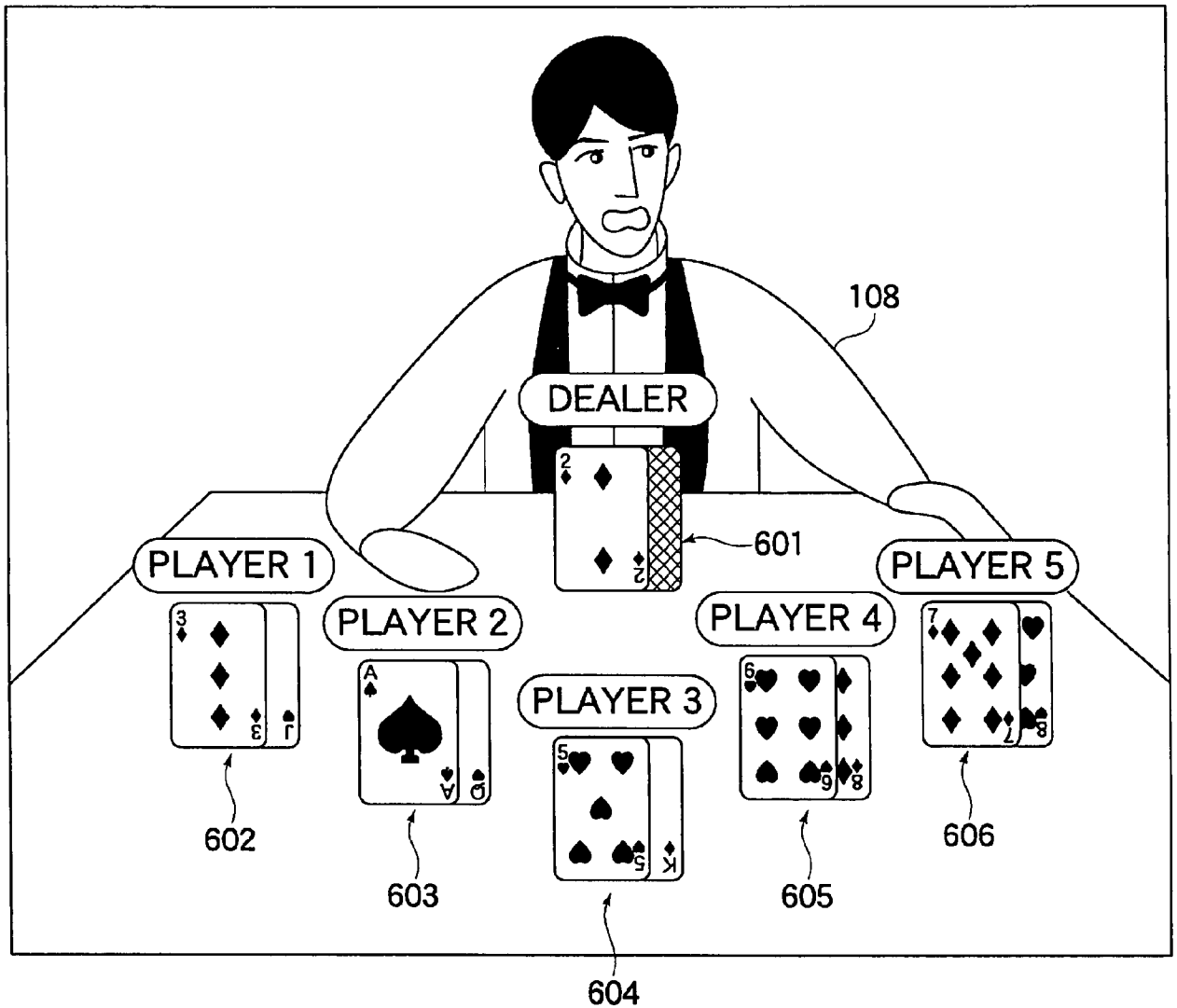

FIG. 12 is a view showing an example of a screen configuration displayed on the front display when executing the effect contents, which differ in accordance with the amount of the bet, in the gaming machine; and FIG. 13 is a view showing an example of a screen configuration displayed on the front display when executing the effect contents, which differ in accordance with the amount of the bet, in the gaming machine.

DESCRIPTION OF THE PREFERRED EMBODIMENTS

Hereafter, a detailed description will be given of a gaming machine according to the invention, while referring to the drawings. Although, hereafter, a description will be given of an embodiment of the invention actualized as a card game, the invention is not limited to this, as the invention can be applied to any gaming machine using credits, and is all the more effective when applied to a gaming machine installed mainly in a casino, such as a slot machine, a roulette machine, a poker machine or a keno machine.

Figure 1:
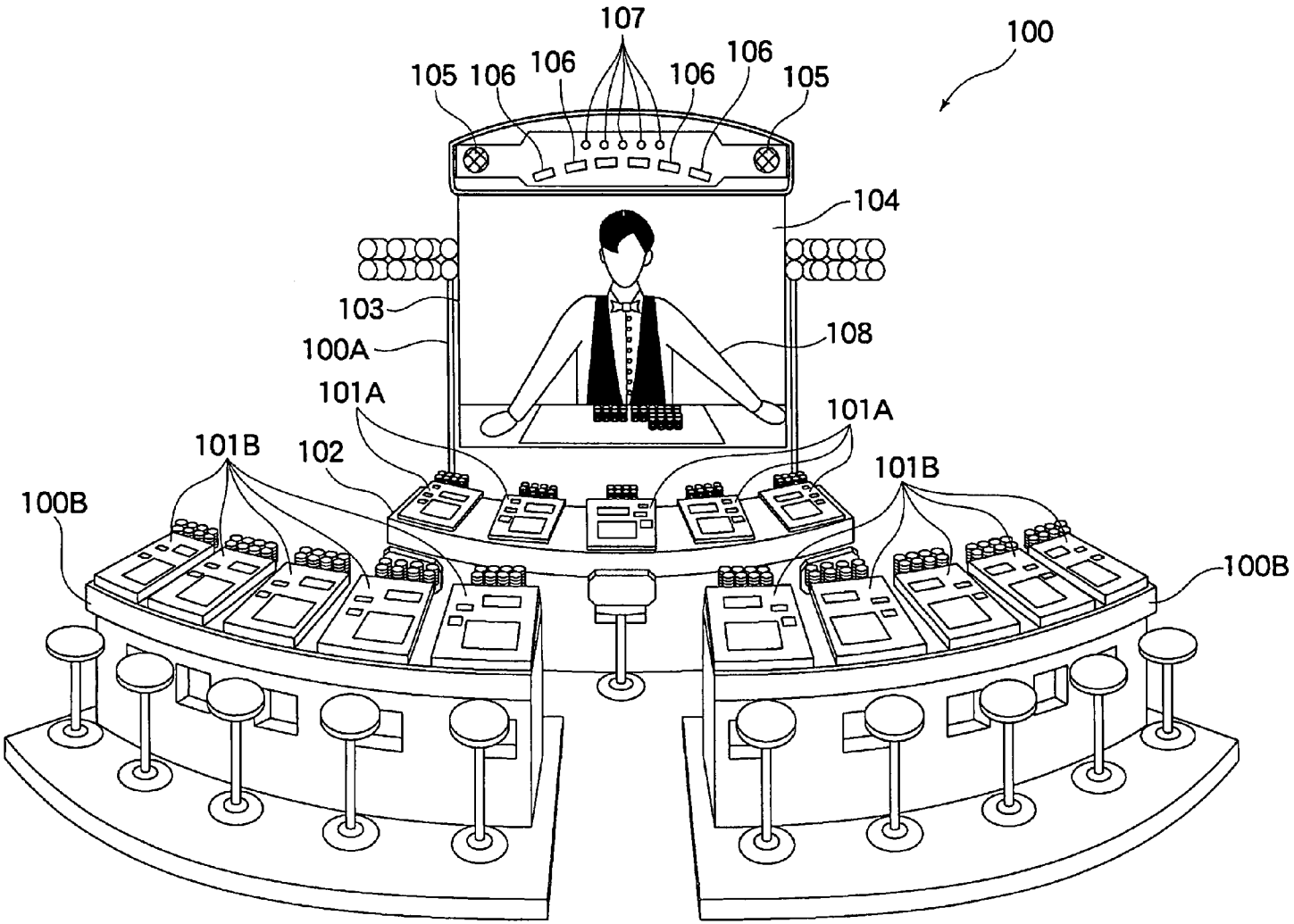
FIG. 1 is an external view of a gaming machine according to an embodiment of the invention.

FIG. 1 is an external view of a gaming machine according to an embodiment of the invention. As shown in FIG. 1, a gaming machine 100 includes a main gaming machine 100A, and two sub-gaming machines 100B which are connected communicably to the main gaming machine 100A.

The main gaming machine 100A includes a terminal 102 on which five main player terminals 101A called satellites are disposed in an approximate fan shape, and a panel 103 positioned in a front of the terminal 102 as seen by an operator (a player) of the terminal 102. Five sub-player terminals 101B are fitted into each of the sub-gaming machines 100B. The player terminals 101 include the main player terminals 101A and the sub-player terminals 101B.

Hereafter, a player who operates the main player terminals 101A will be called a main player, while a player who operates the sub-player terminals 101B will be called a sub-player. In the embodiment, the main player plays a main game provided by the main gaming machine 100A (including, for example, all games carried out in a so-called casino or a game hall, such as a card game such as blackjack, baccarat, poker or keno, a table game such as roulette etc.), while the sub-player plays a sub-game, which is a game in which the main player predicts a game result of the main game and bets one or more coins.

The panel 103 is equipped with a front display 104, which is a display device such as a liquid crystal display device, speakers 105, lamps 106 and LED's 107. The front display 104 relays information related to a whole of a game in which the main player and/or the sub-player participates to each player simultaneously. For example, it is arranged so that a notification of a start or a finish of a bet reception time, a notification of a game outcome and the like, are displayed by an animation of a dealer 108. The speakers 105, the lamps 106 and the LED's 107 carry out effects related to the game, either in conjunction with an image display of the front display 104, or separately and independently of the image display of the front display 104. For example, they carry out effects by an output of background music, sound effects etc., or a turning on and off.

Figure 2:
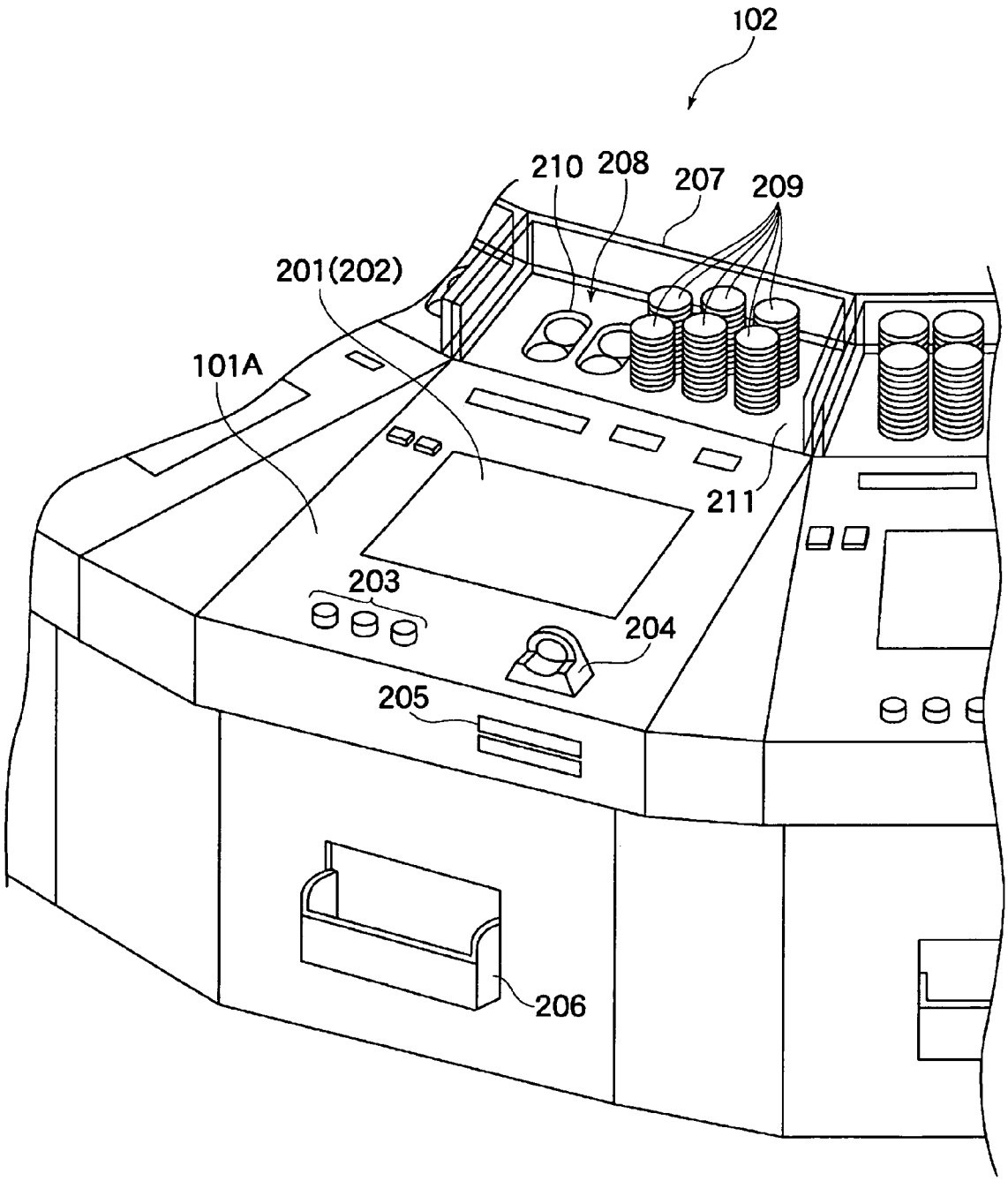
FIG. 2 is a partial enlarged view of a terminal which configures the gaming machine.

FIG. 2 is a partial enlarged view of the terminal 102. Hereafter, a description will be given, while referring to FIG. 2, of a configuration of the terminal 102 and of the main player terminal 101A fitted therein.

The main player terminal 101A includes in a top surface a liquid crystal display 201 for providing information related to the game to the player. The liquid crystal display 201 is covered by a transparent touch panel 202. A plurality of buttons 203, such as a payout button, a bet button etc., which the player uses in the game, is disposed in front of the liquid crystal display 201. A coin insertion slot 204, for the player to insert a coin, which is a game currency medium used to execute the game and includes a medal, a chip, a token and the like (referred to herein simply as a "coin"), is provided to the right of the buttons 203. A coin sensor (not shown) for detecting the coin inserted is provided inside the coin insertion slot 204. A bill insertion slot 205, for the player to insert a bill (the bill includes a ticket and the like; referred to herein simply as a "bill"), is provided below the coin insertion slot 204. A bill sensor (not shown) for detecting the bill inserted is provided inside the bill insertion slot 205.

A coin payout opening 206 is provided in a lower front portion of the main player terminal 101A. The main player terminal 101A is configured in such a way that, in response to a depression by the player of the payout button included in the buttons 203, a plurality of coins corresponding to all or a part of a credit value belonging to the player stored in the main player terminal 101A is ejected from the coin payout opening 206.

A transparent acrylic panel 207 is provided in an inverted, squared U-shape beyond the liquid crystal display 201 (on the panel 103 side), and a three-dimensional model chip presentation section 208 is provided in an area surrounded by the transparent acrylic panel 207. The three-dimensional model chip presentation section 208 includes three-dimensional model chips 209, a presentation section plate 211, on which are provided apertures 210 for the three-dimensional model chips 209 to project from an interior of the player terminal 101 to an exterior, or to store the projected three-dimensional model chips 209 in the interior of the player terminal 101, and an up-down mechanism (not shown) for raising and lowering the three-dimensional model chips 209.

The three-dimensional model chips 209, being a model of a pile of chips, are manufactured by molding a resin or the like. The three-dimensional model chip presentation section 208 has a plurality of three-dimensional model chips 209 of differing units. For example, three-dimensional model chips representing a pile of chips worth one credit each, a pile of chips worth ten credits each, as well as a pile of chips worth one hundred credits each, are prepared. All the players, as well as being able to ascertain promptly and intuitively a credit value belonging to a player by looking at a height to which the three-dimensional model chips 209 project from the presentation section plate 211, can experience a sense of reality just as though actual chips are increasing and decreasing in front of their eyes.

Although, as described heretofore, the sub-player terminal 101B fitted in the sub-gaming machine 100B has a betting option of coins which differs from that of the main player terminal 101A, as an external appearance and a configuration are identical to those of the main player terminal 101A, a detailed description will be omitted.

Figure 3:
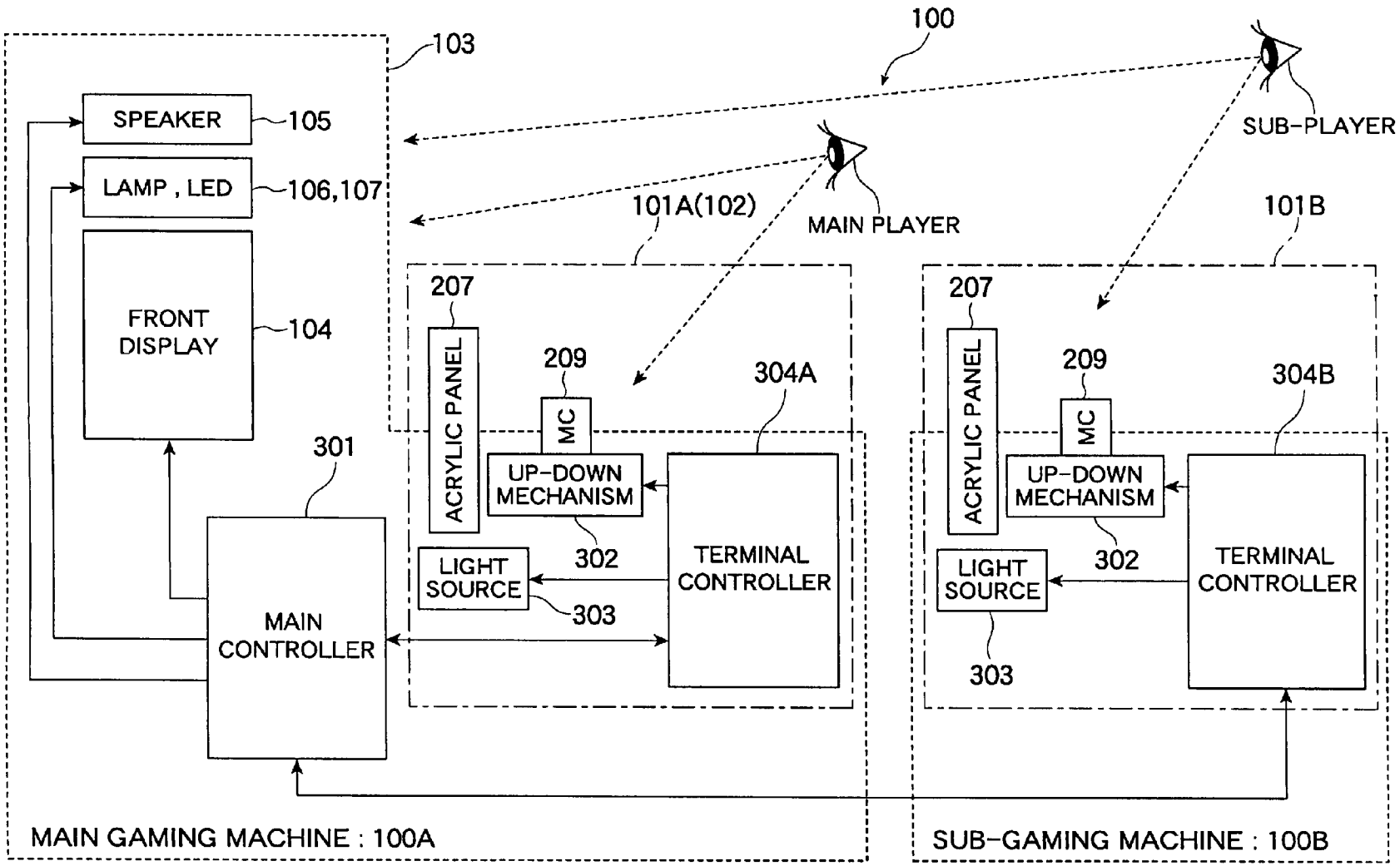
FIG. 3 is a schematic block diagram of an internal structure of the gaming machine.

FIG. 3 is a schematic block diagram showing an internal configuration of the gaming machine 100 according to the embodiment. As shown in the same figure, a main controller 301 is stored in the main gaming machine 100A. The main controller 301, including an information processing device which executes a game program and a peripheral device, is connected in such a way as to enable two-way communication with each of the main player terminal 101A and the sub-player terminal 101B. The main controller 301 receives a notification of a number of chips bet, a betting option etc. from each of the main player terminal 101A and the sub-player terminal 101B, and starts an execution of a game in the event that prescribed conditions have been met. Then, having determined an outcome of a main game and a sub-game, it relays a result to each player terminal 101. Also, it carries out an output control of an image signal to be displayed on the front display 104, a drive control of the lamps 106 and the LED's 107, as well as a drive control of the speakers 105.

Each main player terminal 101A carries out an increase or a reduction of the credit value belonging to the relevant main player in accordance with the notification from the main controller 301. For example, in the event that the main player wins the main game, each main player terminal 101A, in accordance with the notification from the main controller 301, adds a credit value equivalent to a number of chips obtained to the credit value owned, and updates a memory. On the contrary, in the event that the main player loses the main game, each main player terminal 101A, in accordance with the notification from the main controller 301, subtracts a credit value equivalent to a number of chips bet from the credit value owned, and updates the memory.

Each sub-player terminal 101B also operates in the same way as the main player terminal 101A with regard to the sub-game. That is, the sub-player terminal 101B carries out an increase or a reduction of the credit value belonging to the relevant sub-player in accordance with the notification from the main controller 301. For example, in the event that the sub-player wins the sub-game, the sub-player terminal 101B of that sub-player, in accordance with the notification from the main controller 301, adds a credit value equivalent to a number of chips obtained to the credit value owned, and updates a memory. On the contrary, in the event that the sub-player loses the sub-game, each sub-player terminal 101B, in accordance with the notification from the main controller 301, subtracts a credit value equivalent to a number of chips bet from the credit value owned, and updates the memory.

The main player terminal 101A includes a terminal controller 304A including an information processor and peripheral devices, and an up-down mechanism 302 and a light source 303 connected to the terminal controller 304A. The up-down mechanism 302, being a unit for raising and lowering the three-dimensional model chips 209, is equipped, in the embodiment, with a stepping motor as a raising and lowering power. The raising and lowering power is not limited to this, as it is also acceptable to equip it with a regular motor or the like combined with a position limiting mechanism. The light source 303, including a circuit having a light emitting source such as a plurality of LED's, functions as a light source which can change differing colors (for example, red, blue, green, white etc.) and luminance. Light projected from the light source 303 is guided by the transparent acrylic panel 207, and projected to the exterior of the gaming machine 100, particularly in a direction visible to the player.

The sub-player terminal 101B includes a terminal controller 304B including an information processor and peripheral devices, and an up-down mechanism 302 and a light source 303 connected to the terminal controller 304B. The three-dimensional model chips 209 are operated by the up-down mechanism 302, while a light emitting control of the transparent acrylic panel 207 is carried out by the light source 303. As the up-down mechanism 302, the light source 303, the transparent acrylic panel 207 and the three-dimensional model chips 209 are identical to those of the main player terminal 101A, detailed descriptions thereof will be omitted.

Figure 4:
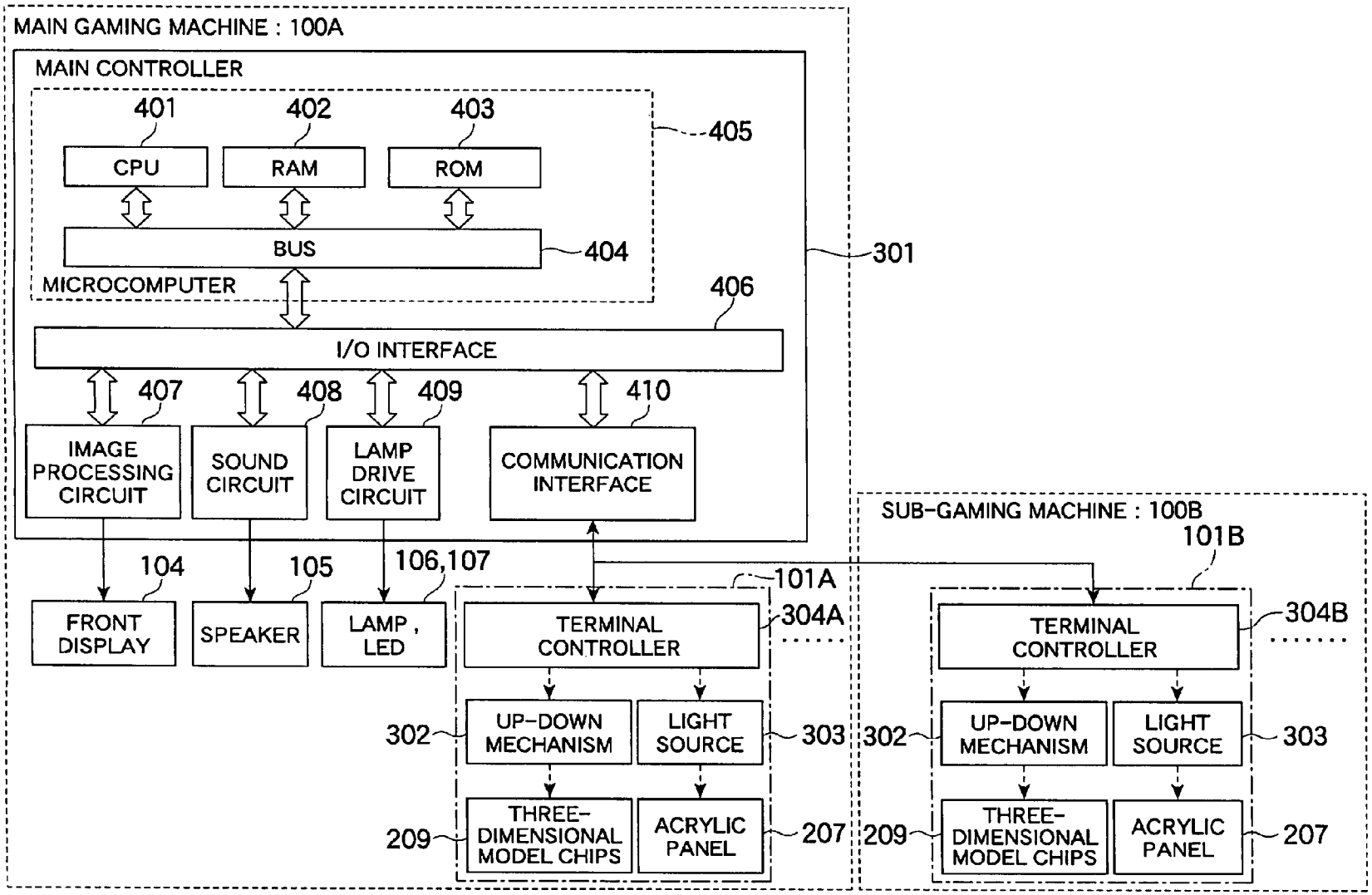
FIG. 4 is a block diagram of the gaming machine centered around a main controller included in the gaming machine.

Next, a description will be given of a configuration example of the main controller 301, while referring to FIG. 4. FIG. 4 is a block diagram of the gaming machine 100, centered around the main controller 301.

The main controller 301 is basically configured to have as its nucleus a microcomputer 405, which includes a CPU 401, an RAM 402, an ROM 403, and a bus 404 for carrying out a reciprocal data transmission between them. The ROM 403 and the RAM 402 are connected to the CPU 401 via the bus 404. Various kinds of program, data table and the like for carrying out processes necessary for a controlling of the gaming machine 100 are stored in the ROM 403. Also, the RAM 402 is a memory which temporarily stores various data calculated by the CPU 401.

The microcomputer 405 (more specifically, the CPU 401) is connected to an image processing circuit 407 via an I/O interface 406. The image processing circuit 407 is connected to the front display 104, and controls a drive of the front display.

The image processing circuit 407 includes a program ROM, an image ROM, an image control CPU, a work RAM, a VDP (Video Display Processor) and a video RAM. An image control program related to a display on the front display 104, and various selection tables, are stored in the program ROM. Dot data for forming, for example, an image on the front display 104 etc., are stored in the image ROM. The image control CPU, based on parameters set by the CPU 401, in accordance with the image control program stored in advance in the program ROM, determines an image to be displayed on the front display 104 from among the dot data stored in advance in the image ROM. The work RAM is configured as a temporary memory device when executing the image control program in the image control CPU. The VDP generates image data corresponding to the display details determined by the image control CPU, and transmits them to the front display 104. The video RAM is configured as a temporary memory device when forming the image in the VDP.

Also, the microcomputer 405 (more specifically, the CPU 401) is connected to the speakers 105 via a sound circuit 408. The speakers 105, based on an output signal from the sound circuit 408, generate various sound effects, background music and the like when carrying out various effects.

Also, the microcomputer 405 (more specifically, the CPU 401) is connected to the lamps 106 and the LED's 107 via a lamp drive circuit 409. The lamps 106 and the LED's 107, being disposed in a large quantity on a front of the gaming machine 100, are controlled as to illumination, when carrying out the various effects, by the lamp control circuit 409 based on a drive signal from the CPU 401.

Also, each player terminal 101 (the main player terminal 101A and the sub-player terminal 101B) being connected to the microcomputer 405 (more specifically, the CPU 401) via a communication interface 410, a two-way communication can be carried out between the CPU 401 and the player terminals 101. As the CPU 401, by means of the communication interface 410, can carry out a transmission and reception of a command, a transmission and reception of a request and the like with each main player terminal 101A, the main controller 301 and the main player terminals 101A cooperate in controlling a progression of the main game. In the same way, as the microcomputer 405 (more specifically, the CPU 401) can carry out a transmission and reception of a command, a transmission and reception of a request and the like with each sub-player terminal 101B via the communication interface 410, the main controller 301 and the sub-player terminals 101B cooperate in controlling a progression of the sub game.

Figure 5:
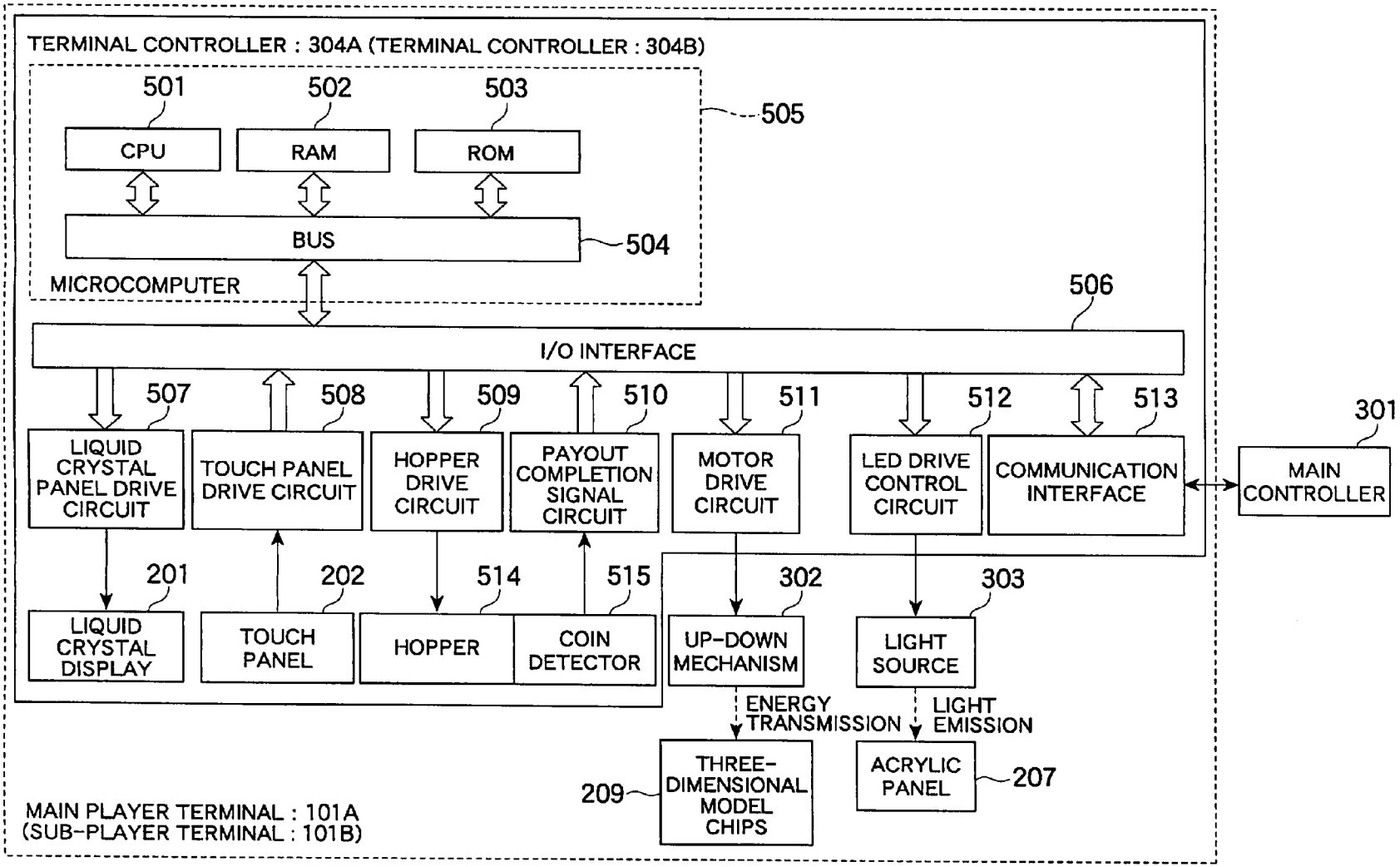
FIG. 5 is a functional block diagram showing a control system of a main player terminal of the gaming machine.

Next, a description will be given of a configuration example of a control system of the main player terminal 101A, while referring to FIG. 5. FIG. 5 is a functional block diagram showing an example of the control system of the main player terminal 101A. As a configuration of a control system of the sub-player terminal 101B is identical to that of the main player terminal 101A, it is appended to the functional block diagram shown in FIG. 5, but a detailed description will be omitted.

A nucleus of the main player terminal 101A (the sub-player terminal 101B) being the terminal controller 304A (the terminal controller 304B), the terminal controller 304A (the terminal controller 304B) is basically configured to have as its nucleus a microcomputer 505, which includes a CPU 501, an RAM 502, an ROM 503, and a bus 504 for carrying out a reciprocal data transmission between them. The ROM 503 and the RAM 502 are connected to the CPU 501 via the bus 504. Various kinds of program, data table and the like for carrying out processes necessary for a controlling of the player terminal 101, for example, an operation control of the up-down mechanism 302, an on/off control of the light source 303 and the like, are stored in the ROM 503. Also, the RAM 502 is a memory which temporarily stores various data calculated by the CPU 501.

The microcomputer 505 (more specifically, the CPU 501) is connected to a liquid crystal panel drive circuit 507 via an I/O interface 506. The liquid crystal panel drive circuit 507, being connected to the liquid crystal display 201, controls a drive of the liquid crystal display 201.

Also, the microcomputer 505 (more specifically, the CPU 501) is connected to a touch panel drive circuit 508 via an I/O interface 506. The touch panel drive circuit 508 outputs coordinate data for a contact position on the transparent touch panel 202.

Also, a hopper 514 is connected to the microcomputer 505 (more specifically, the CPU 501) via a hopper drive circuit 509. When a drive signal is transmitted from the CPU 501 to the hopper drive circuit 509, the hopper 514 pays out a prescribed number of coins from the coin payout opening 206. Also, a coin detector 515 is connected to the CPU 501 via a payout completion signal circuit 510. The coin detector 515 is disposed inside the coin payout opening 206. When detecting that the prescribed number of coins has been paid out from the coin payout opening 206, a coin payout detection signal is transmitted from the coin detector 515 to the payout completion signal circuit 510, based on which the payout completion signal circuit 510 transmits a payout completion signal to the CPU 501.

Also, the microcomputer 505 (more specifically, the CPU 501) is connected to a motor drive circuit 511 which rotationally drives a stepping motor for driving the up-down mechanism 302. When a motor drive signal is transmitted from the CPU 501 to the motor drive circuit 511, the stepping motor is rotationally driven by the motor drive circuit 511. By this means, the up-down mechanism 302 operates, carrying out a raising and lowering of the three-dimensional model chips 209.

Also, the microcomputer 505 (more specifically, the CPU 501) is connected to an LED drive control circuit 512 for driving the light source 303. In the embodiment, the light source 303 including a plurality of LED's, the LED drive control circuit 512, in response to an LED drive command from the CPU 501, supplies drive power to the LED from among all the LED's which is the subject of the drive command. By this means, it is possible to carry out an on/off control of the LED's in a desired aspect under the control of the CPU 501.

In particular, in the embodiment, the light source 303 includes five red LED's, five blue LED's and five white LED's. The LED drive control circuit 512 is configured as a circuit which can selectively supply power in such a way as to individually and independently turn on and off the five red LED's, the five blue LED's and the five white LED's.

Also, the microcomputer 505 (more specifically, the CPU 501) being connected to the main controller 301 via a communication interface 513, a two-way communication can be carried out between the CPU 501 and the main controller 301. As the CPU 501 carries out a transmission and reception etc. of a command, a request, data and the like with the main controller 301, the main controller 301 and the main player terminals 101A (the sub-player terminals 101B) can cooperate in controlling a progression of the main game (the sub-game).

Figure 6:
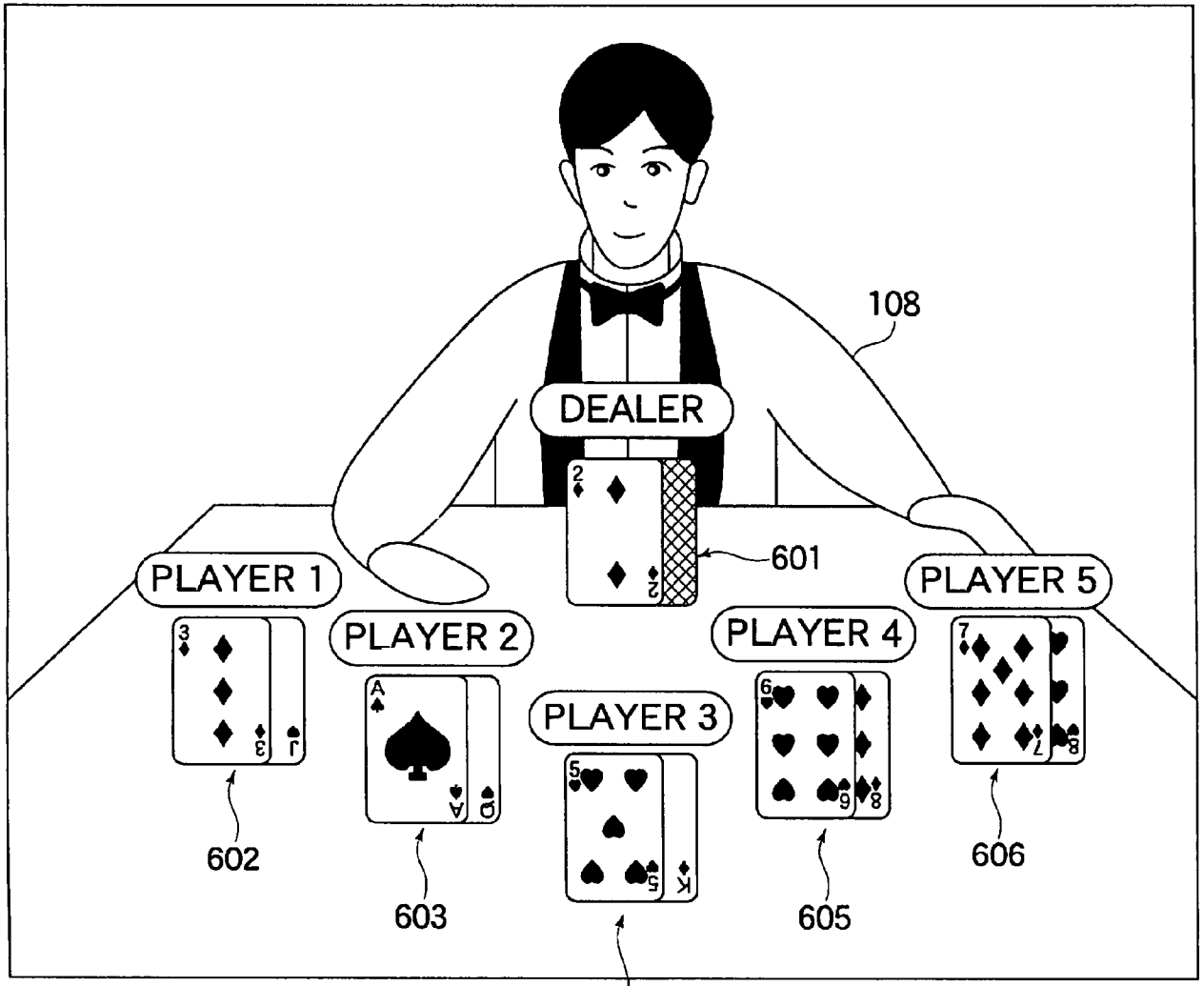
FIG. 6 is a view showing an example of a screen configuration displayed on a front display of the gaming machine.
Figure 7:
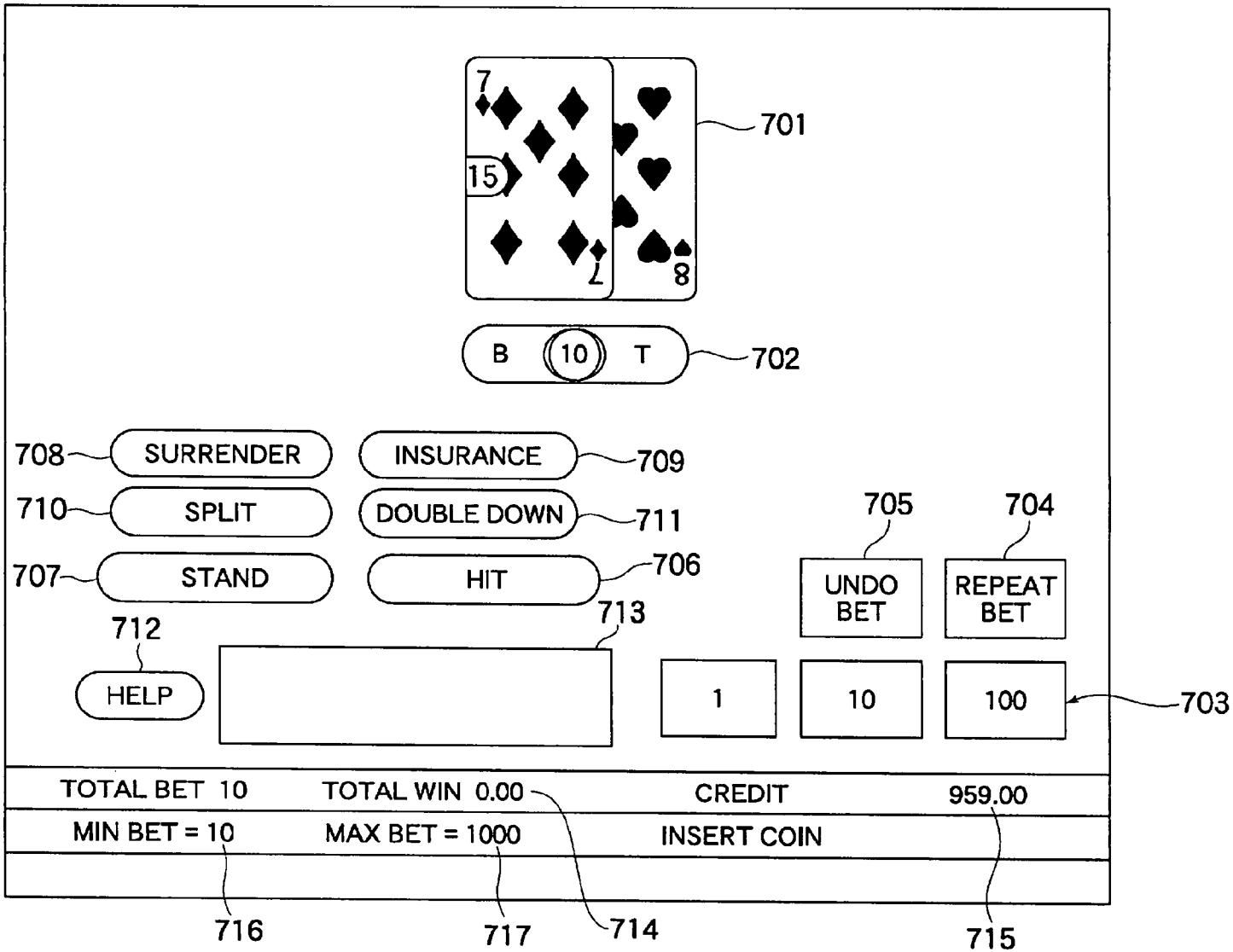
FIG. 7 is a view showing an example of a screen configuration displayed on a liquid crystal display of the main player terminal of the gaming machine.
Figure 8:
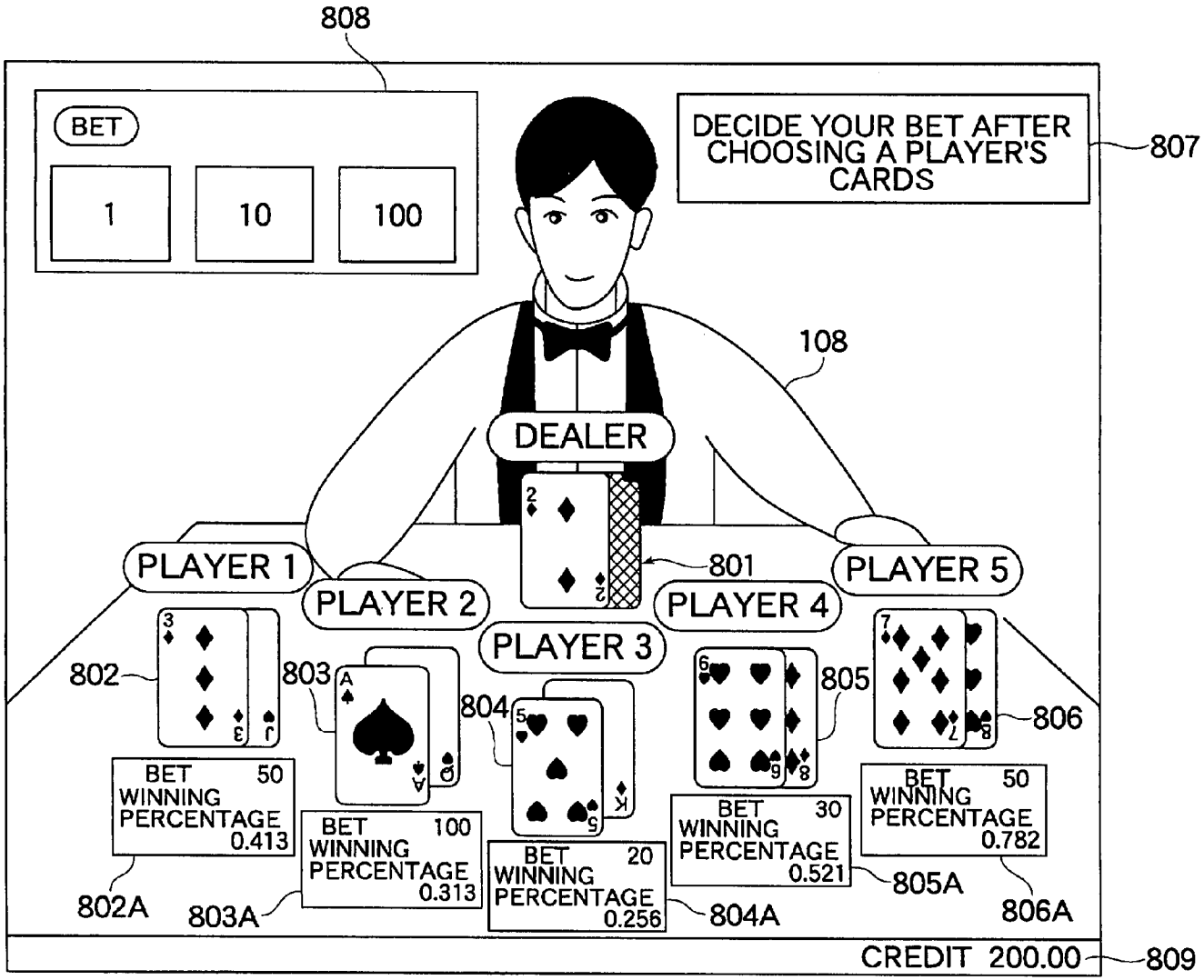
FIG. 8 is a view showing an example of a screen configuration of a transfer request receiving screen displayed on a liquid crystal display of a sub-player terminal of the gaming machine.

At this point, a description will be given, using FIG. 6 to FIG. 8, of examples of a screen configuration displayed on the main gaming machine 100A, the main player terminal 101A and the sub-player terminal 101B when carrying out a game on the gaming machine 100 according to the embodiment. FIG. 6, FIG. 7 and FIG. 8 are figures showing examples of a screen configuration displayed on the front display 104 of the main gaming machine 100A, the liquid crystal display 201 of the main player terminal 101A and the liquid crystal display 201 of the sub-player terminal 101B respectively. Herein, as game contents, a description will be given of a case in which blackjack is played using cards, showing in particular a situation after the cards have been dealt to each player.

As shown in FIG. 6, as well as image data of the dealer 108 being displayed, cards dealt to the dealer (hereafter called "dealer's cards") 601 and cards dealt to the players (hereafter called "players' cards") 602 to 606, are displayed on the front display 104 of the main gaming machine 100A. The dealer's cards 601 are displayed in a front of the dealer 108, while the players' cards 602 to 606 are displayed in positions corresponding to installation positions of each of the main player terminals 101A. Details of each card are updated as appropriate in response to a state of progress of the game. By means of this kind of screen being displayed on the front display 104, it is possible for each player (including players of the sub-player terminals 101B) to confirm what kind of cards have been dealt to each player.

Meanwhile, on the liquid crystal display 201 of the main player terminal 101A, as shown in FIG. 7, player's cards 701 are displayed in a position at a top (the panel 103 side) of the liquid crystal display 201. Also, a chip display area 702 is provided below the player's cards 701. A chip image corresponding to the number of coins bet by the player is displayed in the chip display area 702, carrying out an effect whereby a sense of reality is evoked. In FIG. 7, a case is illustrated in which a chip image corresponding to ten coins is displayed.

A plurality of betting buttons 703 which functions as a bet receiving device is displayed on a lower right of the chip display area 702. The player can input a desired bet value by touching the betting buttons 703 as appropriate. In the example shown in the figure, one each of values "1", "10", and "100" is set on the betting buttons 703, whereby by touching once a number of coins corresponding to the set value is added to the bet value.

A repeat bet button 704 and an undo bet button 705 are displayed above the betting buttons 703. By touching the repeat bet button 704, the player can again bet a number of coins bet in the last game in which he or she participated. Meanwhile, by touching the undo bet button 705, it is possible to cancel a number of coins bet immediately before.

Operating buttons which the player uses when carrying out a maneuvering with the dealer 108 are displayed on a lower left of the chip display area 702. Specifically, a hit button 706, a stand button 707, a surrender button 708, an insurance button 709, a split button 710 and a double down button 711 are displayed as the operating buttons.

The hit button 706 is an operating button touched by the player when requesting a dealing of one more card in addition to the cards dealt. It is possible to continue using the hit button 706 until a total of the numbers on the cards dealt becomes 21 or more. The stand button 707 is an operating button touched when playing with the cards already dealt, without requesting the dealing of a card.

The surrender button 708 is an operating button touched when withdrawing from playing a current game. In the event of selecting the surrender button 708, a half of an amount bet at that point is collected by the dealer, while a remaining half is returned to the player. The insurance button 709 is an operating button touched when taking out insurance for a half of the amount bet at that point against the dealer's cards 601 being a blackjack. The surrender button 708 can be used when the dealer's face up card (visible card) is other than an ace, while the insurance button 709 can be used when the face up card is an ace.

The split button 710 is an operating button touched when, in the event that two cards dealt during the game are of the same number, the cards are split into two hands. By selecting the split button 710, the player can play with each of the two hands. In the event that another card of the same number is dealt after splitting the cards into two hands, it is possible to split the cards again. A maximum of three splits are possible in one game. The double down button 711 is an operating button touched when doubling the amount bet during the game. One card is drawn after selecting the double down button 711, with a condition that no more than that can be drawn.

As well as a help button 712 being displayed, a message area 713 is provided below the hit button 706 and the stand button 707. The help button 712 is a button touched when requesting an explanation of the game (in this case, blackjack). A message supporting the progress of the game is displayed in the message area 713 in response to a current game situation. For example, a message such as "Place a bet" is displayed in a bet reception time. A message explaining the game in the event of selecting the help button 712 is also displayed in the message area 713.

An area (an obtained credit value display area 714) in which the credit value obtained by the player is displayed, and an area (an owned credit value display area 715) in which a credit value owned by the player is displayed, are provided in a bottommost area of the liquid crystal display 201. An area (a bet value lower limit value display area) 716, in which a lower limit value of an amount of the bet is displayed, and an area (a bet value upper limit value display area) 717, in which an upper limit value of a amount of the bet is displayed, are provided. By displaying the lower limit and the upper limit of the amount of the bet, the player is encouraged to determine a amount of the bet which falls within a range indicated thereby.

Also, as shown in FIG. 8, a screen similar to the display screen of the front display 104 of the main gaming machine 100A is displayed on the liquid crystal display 201 of the sub-player terminal 101B. That is, as well as the image data of the dealer 108 being displayed, dealer's cards 801 and players' cards 802 to 806 are displayed. Each card displayed on the liquid crystal display 201 is also updated as appropriate, in the same way as the cards displayed on the front display 104.

The display screen of the liquid crystal display 201 of the sub-player terminal 101B, as well as reference information areas 802A to 806A being provided below the players' cards 802 to 806 respectively, differs from the display screen of the front display 104 in that a message area 807 is provided to a top right of the dealer 108 image data, betting buttons 808 are displayed to a top left of the dealer 108 image data, and an owned credit value display area 809 is provided in a bottom-most area of the liquid crystal display 201.

Reference information for use when determining a betting option and an amount of the bet in the sub-game is displayed in the reference information areas 802A to 806A. FIG. 8 illustrates a case in which an amount bet by player 1 to player 5 in the main game, and a winning percentage in the main game, are displayed in the reference information areas 802A to 806A respectively. Information displayed in the reference information areas 802A to 806A is not limited to this, as it can be changed as appropriate.

A message supporting the progress of the game is displayed in the message area 807 in response to a current game situation. For example, as shown in FIG. 8, a message such as "Decide your bet after choosing a player's cards" is displayed in a bet reception time during which a sub-game bet can be accepted. By touching the betting buttons 808 as appropriate after selecting a player's cards, the player can bet a desired bet value on a specified player.

The gaming machine 100 according to the embodiment, having the above kind of configuration, in the main game, changes effect contents (effect contents using the front display 104 of the main gaming machine 100A, the speakers 105, the lamps 106, the LED's 107 etc.) in the gaming machine 100 when a bet is made according to a number of coins bet (hereafter, "an amount bet" as appropriate). In this way, by changing the effect contents in the gaming machine 100 when the bet is made according to the amount bet, as effect contents which differ according to the amount bet can be provided to the player (including the player of the sub-player terminal 101B), it is possible for the player to experience a sensation of a reality of the game according to the amount bet.

Figure 9:
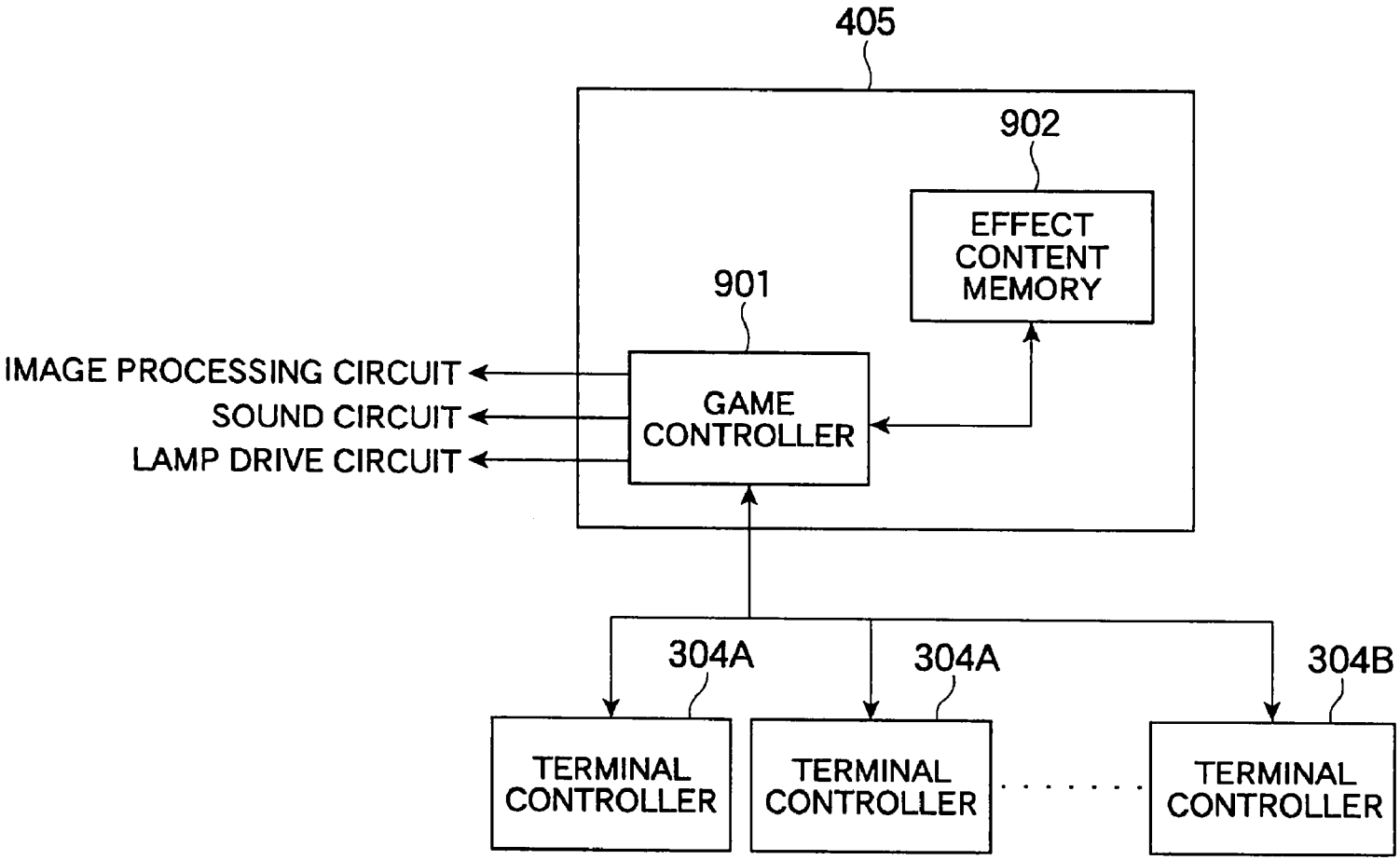
FIG. 9 is a block diagram for illustrating functions of a microcomputer of a main gaming machine.

FIG. 9 is a block diagram for illustrating functions of the microcomputer 405 of the main gaming machine 100A. As shown in the same figure, the microcomputer 405 includes a game controller 901, which forms a game controller by carrying out a progression control of the game in the gaming machine 100 in conjunction with the terminal controllers 304A and 304B of the main player terminal 101A and the sub-player terminal 101B, and an effect content memory 902 which corresponds to a memory.

The game controller 901 carries out a control for progressing the game in the gaming machine 100. For example, as well as receiving an input related to a designation by the player of a amount of the bet, a designation of a strategy in response to the state of progress of the game etc. from the terminal controller 304A etc., it determines an outcome result of the game in accordance with the player's input, and relays the result to the terminal controller 304A etc. Also, it displays a display image corresponding to the player input received on the front display 104 via the image processing circuit 407. At that time, it determines the effect contents in accordance with the information in the effect content memory 902, for example, displaying the display image corresponding to the effect contents on the front display 104.

The effect content memory 902 stores the image data, including the dealer image, displayed on the front display 104. In particular, in the embodiment, it stores an effect content table in which are recorded image data, being image data which express the effect contents when the bet is made, for actualizing effect contents which change the contents of the dealer image in accordance with the amount of the bet. FIG. 10 is a figure showing an example of an effect content table stored in the effect content memory 902. As shown in the same figure, the effect content table is managed in accordance with a main player terminal 101A number (hereafter called a "terminal number" as appropriate) and the amount of the bet. In this way, by managing the effect contents which change the contents of the dealer image in accordance with the terminal number and the amount of the bet in a table, and by specifying the main player terminal 101A on which the bet is made and the amount of the bet, it is possible to easily determine the effect contents to be executed.

In FIG. 10, a case is illustrated in which the amount of the bet is divided into five stages: 10 or less, 11 to 50, 51 to 100, 101 to 200 and over 200, with effect contents A to E being allocated respectively. Effect contents which become progressively showier in an order A to E are set for these effect contents. The reason for effect contents being recorded for each terminal number is to take into consideration the fact that the image data displayed on the front display 104 differs according to the installation position of the main player terminal 101A.

In the gaming machine 100 according to the embodiment, effect contents are employed which, being effect contents which cause an expression and an action of the dealer 108 to change in accordance with the amount of the bet, in particular, increase a degree (a degree of surprise etc.) of a change in the expression and the action of the dealer 108 in accordance with the order A to E (in accordance with the amount of the bet). That is, the game controller 901, in response to an increase in the amount of the bet, executes a control which increases an amount of change in display contents of the dealer image indicating the dealer 108 displayed on the front display 104. Also, when causing the change in the expression etc. of the dealer 108 in accordance with the amount of the bet, the gaming machine 100 links a drive of the speakers 105, the lamps 106 etc. to the degree of change in the expression etc.

Figure 11:
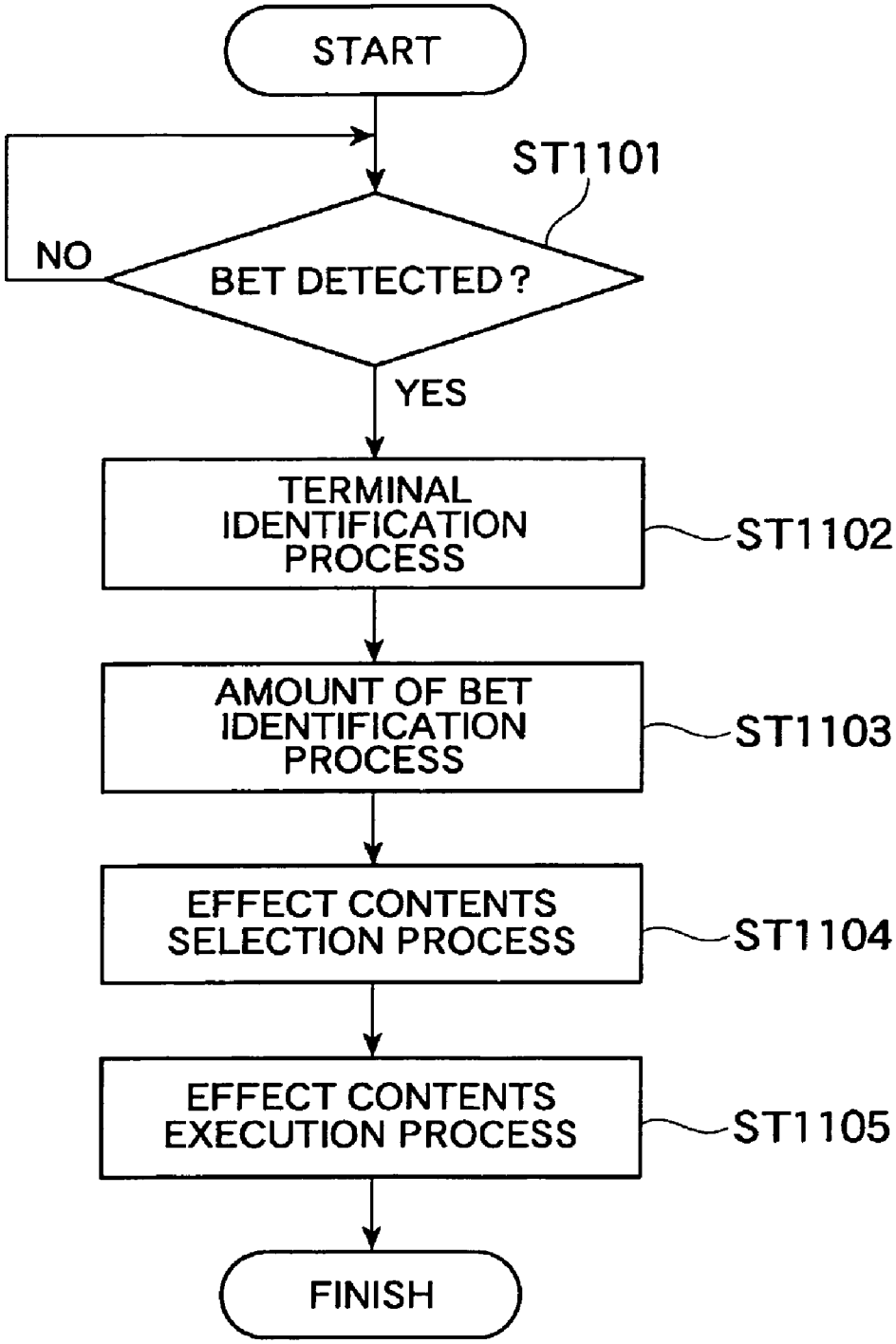
FIG. 11 is a flow diagram for illustrating a process which executes effect contents, which differ in accordance with an amount of a bet, in the gaming machine.

Hereafter, a description will be given of a process which executes the effect contents corresponding to the amount of the bet of the main player in the gaming machine according to the embodiment. FIG. 11 is a flowchart for illustrating the process which executes the effect contents which differ in accordance with the amount of the bet in the gaming machine 100 according to the embodiment.

In a waiting condition, the game controller 901 of the main gaming machine 100A, as shown in FIG. 11, is monitoring whether a designation of a amount of the bet is received from the terminal controller 304A (step (hereafter abbreviated to "ST") 1101). If the designation of the amount of the bet is received, it carries out a process to identify from which of the main player terminals 101A the bet has come (hereafter called a "terminal identification process") (ST1102).

After identifying, by means of the terminal identification process, the main player terminal 101A which designated the amount of the bet, next, the game controller 901 carries out a process to identify a size of the amount of the bet (hereafter called an "betting amount identification process") (ST1103). By identifying the amount of the bet by means of the amount of the bet identification process, the game controller 901 ascertains what size of amount of the bet has been designated by which of the player terminals 101A.

Next, the game controller 901, in accordance with contents ascertained by the processes thus far, carries out a process to select the effect contents to be executed on the front display 104 etc. (hereafter called an "effect content selection process") (ST1104). In the effect content selection process, the game controller 901 selects effect contents from the effect content table stored in the effect content memory 902.

For example, in a case in which the main player terminal 101A of player 5 is identified by the terminal identification process, and the amount of the bet is identified as 30 coins by the betting amount identification process, an effect 5-B shown in FIG. 10 is selected as the effect contents. In the same way, in a case in which the main player terminal 101A of player 5 is identified by the terminal identification process, and the amount of the bet is identified as 120 coins by the betting amount identification process, an effect 5-D shown in FIG. 10 is selected as the effect contents.

Then, when the effect contents have been selected by the effect content selection process, the game controller 901 carries out a process to execute the selected effect contents (hereafter called an "effect content execution process") (ST1105). In the effect content execution process, the game controller 901 causes image data corresponding to the selected effect contents to be displayed on the front display 104. Along with this, it is preferable in the embodiment that sound data corresponding to the effect contents are output from the speakers 105, and that the lamps 106 and the LED's 107 are driven in accordance with the effect contents.

FIG. 12 and FIG. 13 are figures illustrating examples of a screen configuration displayed on the front display 104 in the case in which the effect 5-B and the effect 5-D are selected as the effect contents in the effect content selection process, as described heretofore. Herein, a case is illustrated of an execution of the effect contents causing the change in the expression of the dealer 108 in accordance with the amount of the bet of the main player. Specifically, a case is illustrated in which the amount of surprise in the expression of the dealer 108 becomes progressively bigger in accordance with the amount of the bet.

As shown in FIG. 12, in the event that the effect 5-B is selected, image data is displayed on the front display 104 in which a face of the dealer 108 is facing in a direction of the main player terminal 101A of player 5, and an expression thereon is just a little surprised. Meanwhile, as shown in FIG. 13, in the event that the effect 5-D is selected, image data is displayed on the front display 104 in which the face of the dealer 108 is facing in a direction of the main player terminal 101A of player 5, as with the effect 5-B, but the expression thereon is more surprised than in the case of the effect 5-B.

For example, after executing these kinds of effect contents in the effect content execution process, the game controller 901 completes the process which executes the effect contents in accordance with the amount of the bet of the main player, and moves to a game process which determines an outcome of the game. Then, after determining the outcome of the game, it relays a result to the main player terminal 101A which designated the amount of the bet, causing it to carry out an increase or reduction of the owned credit value.

In this way in the gaming machine 100 according to the embodiment, the game controller 901, by changing the contents of the dealer image when one or more coins are bet according to an amount of the coins bet (the amount of the bet), can present the contents of the dealer image which differ according to the amount of the coins bet (the amount of the bet) to the player, thereby allowing to provide the player with a sensation of a reality of the game according to the amount of the coins bet (the amount of the bet).

In particular, in the gaming machine 100 according to the embodiment, effect contents are executed which increase the change in the contents of the dealer image in response to an increase in the amount of coins bet (the amount of the bet). In this way, as the contents of the dealer image (for example, the expression and the action) change when one or more coins are bet according to the amount of the coins bet (the amount of the bet), it is possible to recreate a sense of actually being face to face with a dealer, in the same way as in a game carried out in a casino.

Also, in the gaming machine 100 according to the embodiment, the sub-player terminal 101B is provided on which the sub-game, in which one or more coins are bet on a game result of the main player, is executed. In this case, as it is possible for the sub-player to evaluate the amount of the bet of the main player based on the effect contents executed by the gaming machine 100, as well as providing an evaluation standard for a betting option by the sub-player, it is possible to heighten an interest of the sub-game in the sub-player.

The invention is not limited to the embodiment described heretofore, as various changes are possible without departing from the spirit and scope of the invention. Regarding sizes and forms shown in the attached drawings in the embodiment, without being limited to these, it is possible to make changes as appropriate within a range which realizes the benefits of the invention. Apart from these, it is possible to implement making changes as appropriate as long as there is no departure from a range of the aim of the invention.

Although, in the embodiment described heretofore, no specification has been made of a kind of bet in the main game, it is also acceptable to change the effect contents on the occasion of a so-called extra bet, which is added during a normal game, in accordance with the amount of the coins bet. In this case, as it is possible, when receiving the extra bet too, to present the effect contents which differ according to the amount of the coins to the player, it is possible to provide the player with a game which has a greater sensation of reality.

Also, the game currency medium to be used in the invention is not limited to the coin, and bills, tokens, tickets, cards and the like are applicable to the invention as well.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A gaming machine comprising:

a plurality of player terminals, each of which is equipped with a display on which a game situation of each player is displayed, and a bet receiving device which receives a bet from the player;

a common display on which, as well as a game situation of each of a plurality of players, a dealer image is displayed;

a processor which controls the player terminals and the common display, and which when the bet receiving device in each of the player terminals receives the bet:

specifies a terminal including the bet receiving device which received the bet and, at the same time, specifies an amount of the bet;

selects effect contents of a dealer image displayed on the common display in accordance with the specified terminal and the specified amount of the bet; and executes the selected effect contents of the dealer image; and a panel comprising a speaker and a lamp, wherein if the processor selects the effect contents such that an expression of the dealer image is changed, then an output of the speaker and the lamp are driven and changed by the processor based on a degree of change in the expression of the dealer image, wherein the degree of change being based on the size of the specified amount of the bet received by the bet receiving device.

2. A gaming machine according to claim 1, further comprising:

a memory including an effect table in which is stored image data, including a plurality of dealer images, correlated to the bet receiving device in each of the plurality of player terminals and the amount of the bet received by each bet receiving device.

3. A gaming machine according to claim 1, further comprising:

a memory including the effect table in which is stored the image data, including the plurality of dealer images, correlated to the bet receiving device in each of the plurality of player terminals and the amount of the bet received by each bet receiving device, wherein the processor, in response to an increase in the amount of the bet, executes a control increasing a degree of change in the display contents of the dealer image displayed on the common display.

4. A gaming machine comprising:

a plurality of player terminals, each of which is equipped with a display on which a game situation of each player is displayed, and a bet receiving device which receives a bet from the player;

a common display on which, as well as a game situation of each of a plurality of players, a dealer image is displayed; and a processor which controls the player terminals and the common display, and which when the bet receiving device in each of the player terminals receives the bet:

specifies a terminal including the bet receiving device which received the bet and, at the same time, specifies an amount of the bet;

selects effect contents of a dealer image displayed on the common display in accordance with the specified terminal and the specified amount of the bet;

displays the selected effect contents of the dealer image; and executes a control of increasing a degree of change in the display contents of the dealer image displayed on the common display in response to an increase in the amount of the bet; and a panel comprising a speaker and a lamp, wherein if the processor selects the effect contents such that an expression of the dealer image is changed, then an output of the speaker and the lamp are driven and changed by the processor based on a degree of change in the expression of the dealer image, wherein the degree of change being based on the size of the specified amount of the bet received by the bet receiving device.

5. A gaming machine according to claim 1, wherein, when the bet receiving device newly receives a bet, a control is executed causing the display contents of the dealer image displayed on the common display to change in accordance with the amount of the bet.

6. A gaming machine according to claim 2, wherein, when the bet receiving device newly receives a bet, a control is executed causing the display contents of the dealer image displayed on the common display to change in accordance with the amount of the bet.

7. A gaming machine according to claim 3, wherein, when the bet receiving device newly receives a bet, a control is executed causing the display contents of the dealer image displayed on the common display to change in accordance with the amount of the bet.

8. A gaming machine according to claim 4, wherein, when the bet receiving device newly receives a bet, a control is executed causing the display contents of the dealer image displayed on the common display to change in accordance with the amount of the bet.

9. A gaming machine according to claim 1, further comprising:

a sub-player terminal on which a bet is carried out after predicting a game result of a player participating in a game using the player terminal.

10. A gaming machine according to claim 2, further comprising:

a sub-player terminal on which a bet is carried out after predicting a game result of a player participating in a game using the player terminal.

11. A gaming machine according to claim 3, further comprising:

a sub-player terminal on which a bet is carried out after predicting a game result of a player participating in a game using the player terminal.

12. A gaming machine according to claim 4, further comprising:

a sub-player terminal on which a bet is carried out after predicting a game result of a player participating in a game using the player terminal.

13. A gaming machine comprising:

a plurality of player terminals, each of which is equipped with a display on which a game situation of each player is displayed, and a bet receiving device which receives a bet from the player;

a sub-player terminal on which a bet is carded out after predicting a game result of a player participating in a game using the player terminal;

a common display on which, as well as a game situation of each of a plurality of players, a dealer image is displayed; and a processor which controls the player terminals, the sub-player terminal and the common display, and which when the bet receiving device in each of the player terminals or the sub-player terminal receives the bet:

specifies a terminal including the bet receiving device which received the bet and, at the same time, specifies an amount of the bet;

selects effect contents of a dealer image displayed on the common display in accordance with the specified terminal and the specified amount of the bet; and executes the selected effect contents of the dealer image; and a panel comprising a speaker and a lamp, wherein if the processor selects the effect contents such that an expression of the dealer image is changed, then an output of the speaker and the lamp are driven and changed by the processor based on a degree of change in the expression of the dealer image, wherein the degree of change being based on the size of the specified amount of the bet received by the bet receiving device.

14. A gaming machine according to claim 13, wherein, when the bet receiving device newly receives a bet, a control is executed causing the display contents of the dealer image displayed on the common display to change in accordance with the amount of the bet.

15. A gaming machine according to claim 1, further comprising:

a memory including an effect table comprising an effect content corresponding to a terminal in said plurality of player terminals, and a bet amount of a plurality of bet amounts.

16. A gaming machine according to claim 15, wherein said effect content corresponding to said terminal comprises a face of said dealer image facing in a direction of said terminal.

17. A gaming machine according to claim 15, wherein said plurality of bet amounts comprises a first bet amount and a second bet amount which is greater than said first bet amount, an effect content for said second bet amount causing a change in expression in said dealer image which is of a greater degree than a change in expression in said dealer image for said effect content for said first bet amount.

18. A gaming machine according to claim 17, wherein said degree of expression in said dealer image comprises a degree of surprise in said expression in said dealer image.

19. A gaming machine according to claim 17, wherein said degree of expression in said dealer image comprises a degree of expression on a face of said dealer image.

20. A gaming machine according to claim 1, wherein the panel is located in front of the plurality of player terminals, and the speaker comprises a plurality of speakers and the lamp comprises a plurality of lamps.

21. A gaming machine according to claim 1, wherein the panel further comprises the common display on which the dealer image is displayed.

* * * * *